US010747157B2

(12) United States Patent
Zuo

(10) Patent No.: US 10,747,157 B2
(45) Date of Patent: Aug. 18, 2020

(54) IMAGE FORMING APPARATUS, IMAGE FORMING SYSTEM, AND NON-TRANSITORY RECORDING MEDIUM STORING COMPUTER-READABLE PROGRAM FOR IMAGE FORMING APPARATUS

(71) Applicant: KONICA MINOLTA, INC., Chiyoda-ku, Tokyo (JP)

(72) Inventor: Yong Zuo, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 301 days.

(21) Appl. No.: 15/835,554

(22) Filed: Dec. 8, 2017

(65) Prior Publication Data

US 2018/0164727 A1 Jun. 14, 2018

(30) Foreign Application Priority Data

Dec. 12, 2016 (JP) ..... 2016-240451

(51) Int. Cl.
*G03G 15/00* (2006.01)
*G03G 21/14* (2006.01)
(Continued)

(52) U.S. Cl.
CPC ..... *G03G 15/50* (2013.01); *B41J 13/0009* (2013.01); *B65H 31/02* (2013.01);
(Continued)

(58) Field of Classification Search
CPC .... G03G 15/6564; G03G 15/50; B65H 43/00; B65H 37/00; B41J 13/0009
See application file for complete search history.

(56) References Cited

U.S. PATENT DOCUMENTS 6,213,658 B1 4/2001 Nishimura
7,413,178 B2 * 8/2008 Fujii ..... B65H 29/51 270/58.01

(Continued)

FOREIGN PATENT DOCUMENTS

JP 2000-264448 A 9/2000
JP 2010-100411 A 5/2010
JP 2016-060606 A 4/2016

*Primary Examiner* — Patrick Cicchino
(74) *Attorney, Agent, or Firm* — Buchanan Ingersoll & Rooney PC

(57) ABSTRACT

An image forming apparatus includes a conveyor that conveys a recording medium; an image former that performs image formation for the recording medium; a receiver that receives an instruction of adjustment start of post pressing condition by a post processing apparatus without stopping a print job during continuous output operation that performs image formation continuously for a plurality of recording mediums, performs post processing by the post processing apparatus, and outputs the plurality of recording mediums; and a hardware processor that performs interval widening control for the recording medium being conveyed on a conveyance passage so as to convey the recording medium by widening an interval with a preceding recording medium from a time when the instruction of adjustment start of the post processing condition has been received.

25 Claims, 11 Drawing Sheets

(51) Int. Cl.

| | |
|---|---|
| ***B65H 31/02*** | (2006.01) |
| ***B65H 31/34*** | (2006.01) |
| ***B41J 13/00*** | (2006.01) |
| ***B65H 37/00*** | (2006.01) |
| ***B65H 43/00*** | (2006.01) |

(52) U.S. Cl.

CPC ..... *B65H 31/34* (2013.01); *B65H 37/00* (2013.01); *B65H 43/00* (2013.01); *G03G 15/6564* (2013.01); *G03G 21/14* (2013.01); *B65H 2301/4213* (2013.01); *B65H 2301/42146* (2013.01); *B65H 2301/4452* (2013.01); *B65H 2511/11* (2013.01); *B65H 2511/22* (2013.01); *B65H 2511/30* (2013.01); *B65H 2513/53* (2013.01); *B65H 2515/112* (2013.01); *B65H 2801/27* (2013.01); *G03G 15/6541* (2013.01)

(56) References Cited

U.S. PATENT DOCUMENTS

| | | | | |
|---|---|---|---|---|
| 8,630,576 | B2 * | 1/2014 | Kokura ..... | B65H 37/04 399/397 |
| 8,985,573 | B2 * | 3/2015 | Konishi ..... | B65H 39/00 271/176 |

* cited by examiner

IMAGE FORMING APPARATUS, IMAGE FORMING SYSTEM, AND NON-TRANSITORY RECORDING MEDIUM STORING COMPUTER-READABLE PROGRAM FOR IMAGE FORMING APPARATUS

CROSS-REFERENCE TO RELATED APPLICATION

This application claims a priority under the Paris Convention of Japanese patent application No. 2016-240451 filed on Dec. 12, 2016, the entirety of which is incorporated herein by references.

BACKGROUND

1. Technological Field

The present invention relates to an image forming apparatus, an image forming system, and a non-transitory recording medium storing a computer-readable program for the image forming apparatus.

2. Description of the Related Art

There is an image forming system that performs image formation on sheets based on a print job, and performs various kinds of post processing, such as folding, punching, and stitching for the sheets having been subjected to the image formation.

In such the image forming system, in order to maintain the quality of printed matters, there are techniques to adjusting operation of each device of the image forming system.

The Unexamined Japanese Patent Publication No. 2010-100411 discloses an image forming apparatus that includes a corrector to correct curl of a sheet released from a roll sheet, and a conveyor to convey the sheet at a changeable conveyance speed. In this image forming apparatus, when stopping conveyance of the sheet, the degree of curl correction is weakened while the conveyance speed is being reduced gradually. On the other hand, when starting conveyance of the roll sheet, the degree of curl correction is strengthened while the conveyance speed is being increased gradually. Thereby, even if the sheet is a thick sheet, the curl correction can be performed with reducing curl provided in a reverse direction.

The Unexamined Japanese Patent Publication No. 2016-60606 discloses an image forming apparatus that includes a fixer to fix a toner image onto a sheet by heating and pressing, and a curl corrector to correct curl by conveying the sheet with the fixed toner image at different speeds between the center side and the end sides in a width direction intersecting with a conveyance direction. In this image forming apparatus, by providing a difference in the conveyance speed between the center side and the end sides, certain stiffness is provided to the sheet. Thereby, the curl caused on the sheet by fixing the toner image can be corrected.

SUMMARY

In such an image forming system, there may be a case where there is a need to change the setting of adjustment values for operation of each device without stopping the print job during continuous output operation that performs image formation continuously for multiple sheets, performs post processing for the sheets, and outputs the sheets (hereinafter, referred to as "real-time adjustment"). For example, the case is that, when minor misalignment with a degree not becoming quality defects has occurred on the sheets discharged after the post processing, the degree of misalignment of the sheets is made small by adjusting the position of discharged-sheet aligning plates.

However, the sheets discharged after the post processing during the real-time adjustment includes minor defect such as minor misalignment of the sheets although the degree of the minor defects does not become quality defects. Therefore, during the real-time adjustment, there is a problem that a lot of paper sheets with such minor defects are caused.

Moreover, a user wants to confirm immediately whether the changing of the setting of the adjustment value in the real-time adjustment has been proper. However, in the case where the setting of the adjustment value has been changed during the continuous output operation, since the sheets are discharged continuously onto a sheet delivery tray, there is a problem that it is difficult for the user to grasp from which sheet the changing of the setting of the adjustment values has been applied.

On the other hand, the conventional techniques disclosed in the above patent documents do not cope with the above-mentioned problems.

The present invention has been made in order to solve the above problems. That is, an object is to provide the image forming apparatus that reduces an amount of sheets discharged with minor defects during real-time adjustment and makes it possible to confirm easily the sheet to which the changing of the adjustment value is reflected.

To achieve at least one of the abovementioned objects, according to an aspect of the present invention, the image forming apparatus reflecting one aspect of the present invention, comprises: a conveyor that conveys a recording medium on a conveyance passage; an image former that performs image formation for the recording medium being conveyed; a receiver that receives an instruction of adjustment start of post processing condition by a post processing apparatus without stopping a print job during continuous output operation that performs image formation continuously for a plurality of recording mediums, performs post processing for the plurality of recording mediums by the post processing apparatus, and outputs the plurality of recording mediums; and a hardware processor that performs interval widening control for the recording medium being conveyed on the conveyance passage so as to convey the recording medium by widening an interval with a preceding recording medium from a time when the instruction of adjustment start of the post processing condition has been received.

To achieve at least one of the abovementioned objects, according to an aspect of the present invention, an image forming system reflecting one aspect of the present invention, comprises: a conveyor that conveys a recording medium on a conveyance passage; an image former that performs image formation for the recording medium being conveyed; a post processor that performs post processing for the recording medium having been subjected to image formation; a receiver that receives an instruction of adjustment start of post processing condition by the post processor without stopping a print job during continuous output operation that performs image formation continuously for a plurality of recording mediums, performs post processing for the plurality of recording mediums, and outputs the plurality of recording mediums; and a hardware processor that performs interval widening control for a recording medium being conveyed on the conveyance passage so as to convey the recording medium by widening an interval with a preceding recording medium from a time when an instruction of adjustment start of the post processing condition has been received.

To achieve at least one of the abovementioned objects, according to an aspect of the present invention, a non-transitory recording medium storing a computer-readable program reflecting one aspect of the present invention causing an image forming apparatus to perform: (a) conveying a recording medium on a conveyance passage; (b) performing image formation for a recording medium being conveyed; (c) receiving an instruction of adjustment start of post pressing condition by an post processing apparatus without stopping a print job during continuous output operation that performs image formation continuously for a plurality of recording mediums, performs post processing for the plurality of recording mediums by the post processing apparatus, and outputs the plurality of recording mediums; and (d) performing interval widening control for a recording medium being conveyed on the conveyance passage so as to convey the recording medium by widening an interval with a preceding recording medium from a time when an instruction of adjustment start of the post processing condition has been received.

The objects, features, and characteristics of this invention other than those set forth above will become apparent from the description given herein below with reference to preferred embodiments illustrated in the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
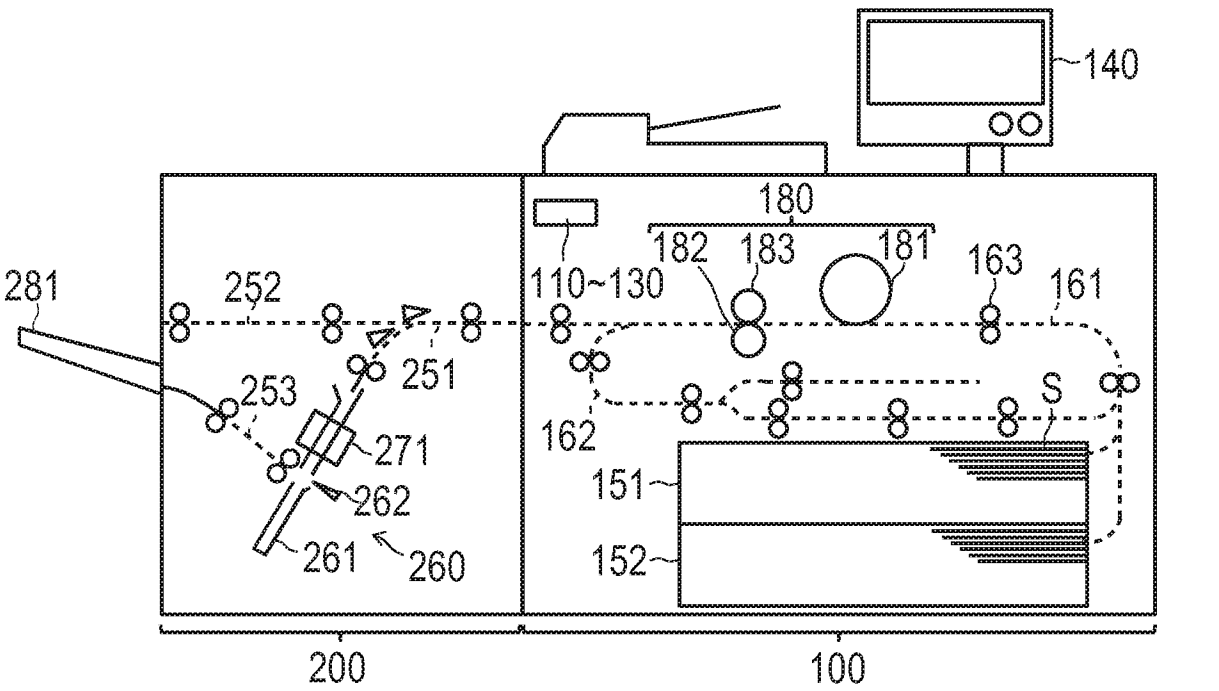
FIG. 1 is an entire constitution diagram showing an outline of an image forming system according to an embodiment of the present invention.

Hereinafter, one or more embodiments of the present invention will be described with reference to the drawings. However, the scope of the invention is not limited to the disclosed embodiments.

Hereinafter, with reference to the attached drawings, an image forming apparatus, an image forming system, and non-transitory recording medium storing the computer-readable program for the image forming apparatus according to embodiments of the present invention will be described in detail. In the drawings, the same element is provided with the same sign, and the duplicate description is omitted. Moreover, dimension ratios in the drawings are exaggerated on account of description so that the dimension ratios may be different from actual dimension ratios.

Figure 2:
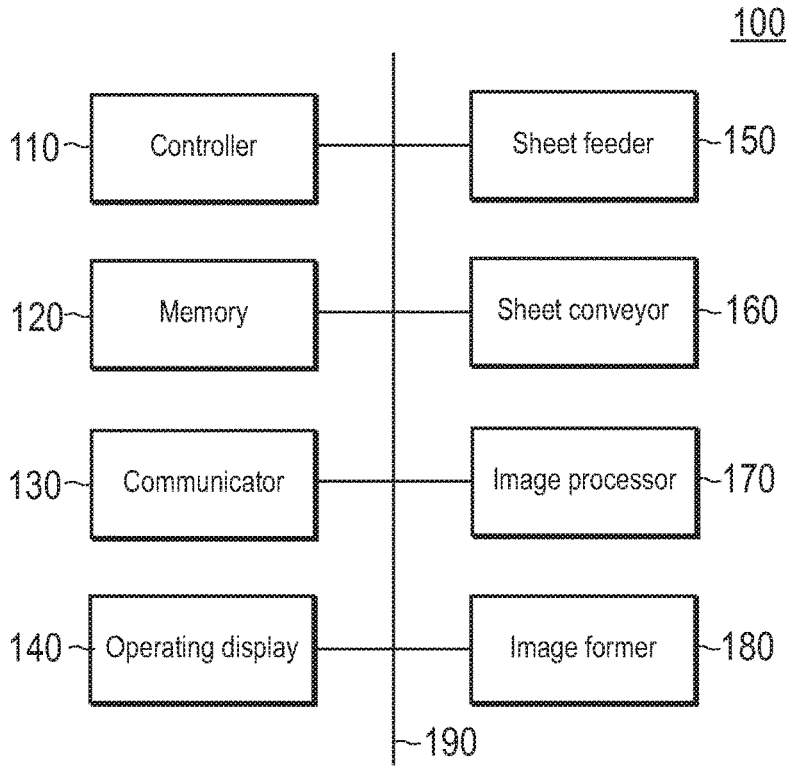
FIG. 2 is a block diagram of an image forming apparatus according to the embodiment of the present invention.
Figure 3:
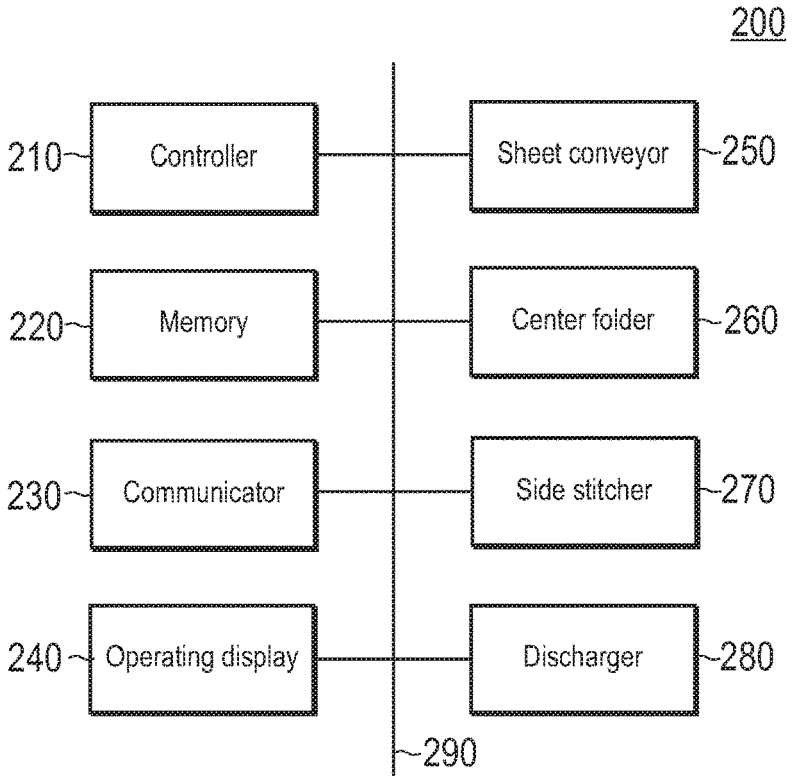
FIG. 3 is a block diagram of a post processing apparatus.

FIG. 1 is an entire constitution diagram showing an outline of the image forming system according to an embodiment of the present invention. FIG. 2 is a block diagram of the image forming apparatus included in the image forming system. FIG. 3 is a block diagram of a post processing apparatus included in the image forming system.

The image forming system 10 includes the image forming apparatus 100 and the post processing apparatus 200. The image forming apparatus 100 and the post processing apparatus 200 are connected with each other via dedicated signal lines so as to be able to communicate with each other. A sheet S being a recording medium is subjected to image formation by the image forming apparatus 100 in accordance with a print job, thereafter, subjected to post processing by the post processing apparatus 200, and then, discharged onto a sheet delivery tray 281.

The print job is a general term of printing instructions for the image forming apparatus 100, and the print job includes print data and print settings. The print data is data of a document which is a target of printing, and the print data includes various kinds of data, such as image data, vector data, and text data. In particular, print data may be PDL (Page Description Language) data, PDF (Portable Document Format) data, or TIFF (Tagged Image File Format) data. The print setting is the setting with regard to image formation and post processing for the sheets S, and includes various kinds of setting, such as the number of print sets, the kind of the sheet, the selection of color print or monochrome print, the alignment of the sheets (misalignment correction of sheets), the folding of the sheet, and the stitching of the sheets.

Each constitution of the image forming system 10 will be described.

Image Forming Apparatus

The image forming apparatus 100 includes a controller 110, a memory 120, a communicator 130, an operating display 140, a sheet feeder 150, a sheet conveyor 160, an image processor 170, and an image former 180. These devices are connected with each other via bus 190 to exchange signals.

The controller 110 includes, for example, a CPU (Central Processing Unit), and performs control for each of the above devices and various kinds of arithmetic processing in accordance with programs. The actions of the controller 110 will be described later in detail.

The memory 120 includes a RAM (Random Access Memory), a ROM (Read Only Memory), and an HDD (Hard Disk Drive). The RAM memorizes programs and data temporarily as the working region of the processor 110. The ROM stores various programs and various kinds of data beforehand. The HDD memorizes various programs and various kinds of data.

The communicator 130 is an interface to communicate with other apparatuses via cables or wireless. As the communicator 130, network interfaces according to standards, such as Ethernet (registered trademark), SATA, PCI Express, USB, IEEE1394, and the like may be used. Moreover, as the communicator 103, various kinds of local connection interfaces, such as wireless communication interfaces, such as Bluetooth (registered trademark) and IEEE802.11, and the like may be used.

The operating display 140 includes a liquid crystal display panel to display various kinds of information, a touch panel to input various kinds of instruction and settings, numeric keypads to set the number of copy sheets, a start key to instruct the start of operation, a stop key to instruct the stop of operation, and a reset key to initialize various kinds of setting conditions. The operating display 140 constitutes a receiver.

The sheet feeder 150 includes a plurality of sheet feed trays 151, 152. The sheet feeder 150 feeds the sheets S stored in the sheet feed trays 151, 152 to a sheet conveyance passage 161.

The sheet conveyor 160 includes conveyance passages 161, 162, a plurality of conveyance roller pairs including registration rollers 163 and disposed along the conveyance passages 161, 162, and motors (not-illustrated) to drive these conveyance roller pairs. The sheet S fed from the sheet feeder 150 is conveyed on the conveyance passages 161, 162 to the image former 180. In the case of performing image formation to both sides of the sheet S, the sheet S having subjected to image formation by the image former 180 is conveyed on the conveyance passage 162, and then, the front and back surfaces of the sheet S are reversed. Thereafter, the sheet S is conveyed again to the image former 180 via the conveyance passage 161, and the back surface of the sheet S is subjected to image formation. The sheet conveyor 160 constitutes a conveyor.

The image processor 170 performs layout processing and rasterization processing for print data included in the print job received by the communicator 130, and generates image data which is data of an image in a bit map format.

The image former 180 performs image formation on the sheet S based on image data through processes of charging, exposing, developing, transferring, and fixing with an electrophotographying system, and outputs the sheet S to the post processing apparatus 200.

The controller 110 determines whether the operating display 140 has received an instruction (hereafter, referred to as a "condition adjustment start instruction") to start the adjustment of post processing condition that is the setting condition of the post processing performed by the post processing apparatus 200. The situation that the operating display 140 has received the condition adjustment start instruction can be determined based on the situation that an operation screen for real-time adjustment has been displayed on the operating display 140 by a user in order to execute the real-time adjustment. The post processing condition includes the position of a discharged-sheet aligning plate to align discharged sheets S and the position of a sheet stacker 261 to determine the position of center folding and the position of side stitching in the post processing apparatus 200.

When controller 110 has determined that the instruction of post processing condition adjustment start has been received, the controller 110 performs control (hereinafter, referred to as "interval widening control") of the conveyance of the sheet S conveyed on the conveyance passage 161, 162 so as to widen an interval between the sheet S and the preceding sheet S. That is, from the time when the instruction of post processing condition adjustment start has been received, the controller 110 controls the conveyance of the sheet S conveyed on the conveyance passage 161, 162 so as to widen the interval between the sheet S and the preceding sheet S than the interval before the condition adjustment start instruction has been received. By widening the interval between the sheet S and the preceding sheet S on the conveyance passage 161, 162, the number of sheets S that are conveyed from the image forming apparatus 100 to the post processing apparatus 200, subjected to post processing, and then discharged, per unit time is reduced. For this reason, the user can check easily sheets having been subjected to the post processing after the adjustment of the post processing condition has been started. The controller 110 can perform the interval widening control for a part of the sheets S conveyed on the conveyance passages 161, 162 as sheets S of targets of the interval widening control.

The control for widening the interval between the sheet S on the conveyance passages 161, 162 and the preceding sheet S can be performed in the following manners.

For example, the conveyance speed of the sheet S passing through a predetermined position on the conveyance passage 161, 162 is changed from the first conveyance speed before the interval widening control to a second conveyance speed slower than the first conveyance speed, thereby it is possible to widen the interval between the sheet S and the preceding sheet S conveyed at the first conveyance speed. At that time, if necessary, it is possible to perform control to delay the sheet feeding timing from the sheet feeder 150, decrease the rotation speed of a photoreceptor drum 181, and decrease the rotation speed of a pressing roller 182 and a heating roller 183. The above predetermined position may be set at, for example, the position of the registration rollers 163.

In accordance with a predetermined condition, the second conveyance speed may be set to a second conveyance speed corresponding to the predetermined condition. The predetermined condition includes a condition relating to at least one of, for example, the length of the sheet in the conveyance direction, the basis weight of the sheet, the number of sheets included in a set of prints (hereinafter, merely referred to as a "set") that includes a plurality of sheets and is a print unit of the same document, and the time required for post processing by the post processing apparatus 200. The reason why the second conveyance speed is changed in accordance with such the predetermined condition, is to suppress the increasing of an amount of sheets discharged with minor defects due to the predetermined condition during real-time adjustment.

In the case where the second conveyance speed is set in accordance with the condition with regard to the length of the sheet in the conveyance direction, the second conveyance speed is set to a slower speed as the length of the sheet in the conveyance direction is shorter. In the case where the second conveyance speed is set in accordance with the condition with regard to the basis weight of the sheet, the second conveyance speed is set to a slower speed as the basis weight of the sheet is smaller. In the case where the second conveyance speed is set in accordance with the condition with regard to the number of sheets included in the set, the second conveyance speed is set to a slower speed as the number of sheets included in the set is smaller. In the case where the second conveyance speed is set in accordance with the condition with regard to the time required for post processing by the post processing apparatus 200, the second conveyance speed is set to a slower speed as the time required for the post processing is shorter. In the case where the predetermined condition include a plurality of predetermined conditions, the second conveyance speed is set to the slowest speed among the second conveyance speeds corresponding to the respective predetermined conditions.

On the other hand, the interval between the sheet S and the preceding sheet S may be widened by stopping temporarily the sheet S passing through the predetermined position on the conveyance passages 161, 162. The predetermined position may be set at, for example, the position of the registration rollers 163.

The stopping time at the time of stopping temporarily the sheet S passing through the above predetermined position, may be set in accordance with the predetermined condition to the stopping time corresponding to the predetermined condition. The predetermined condition include a condition relating to at least one of, for example, the length of the sheet in the conveyance direction, the basis weight of the sheet, the number of sheets included in the set, and the time required for post processing by the post processing apparatus 200. The reason why the stopping time is changed in accordance with such the predetermined condition, is to suppress the increasing of an amount of sheets discharged with minor defects due to the predetermined condition during real-time adjustment.

In the case where the stopping time is set in accordance with the condition with regard to the length of the sheet in the conveyance direction, the stopping time is set to longer time as the length of the sheet in the conveyance direction is shorter. In the case where the stopping time is set in accordance with the condition with regard to the number of sheets included in the set, the stopping time is set to longer time as the number of sheets included in the set is smaller. In the case where the stopping time is set in accordance with the condition with regard to the time required for post processing by the post processing apparatus 200, the stopping time is set to longer time as the time required for the post processing is shorter. In the case where the predetermined condition includes a plurality of predetermined conditions, the stopping time is set to the longest time among the stopping times corresponding to the respective predetermined conditions.

Figure 4:
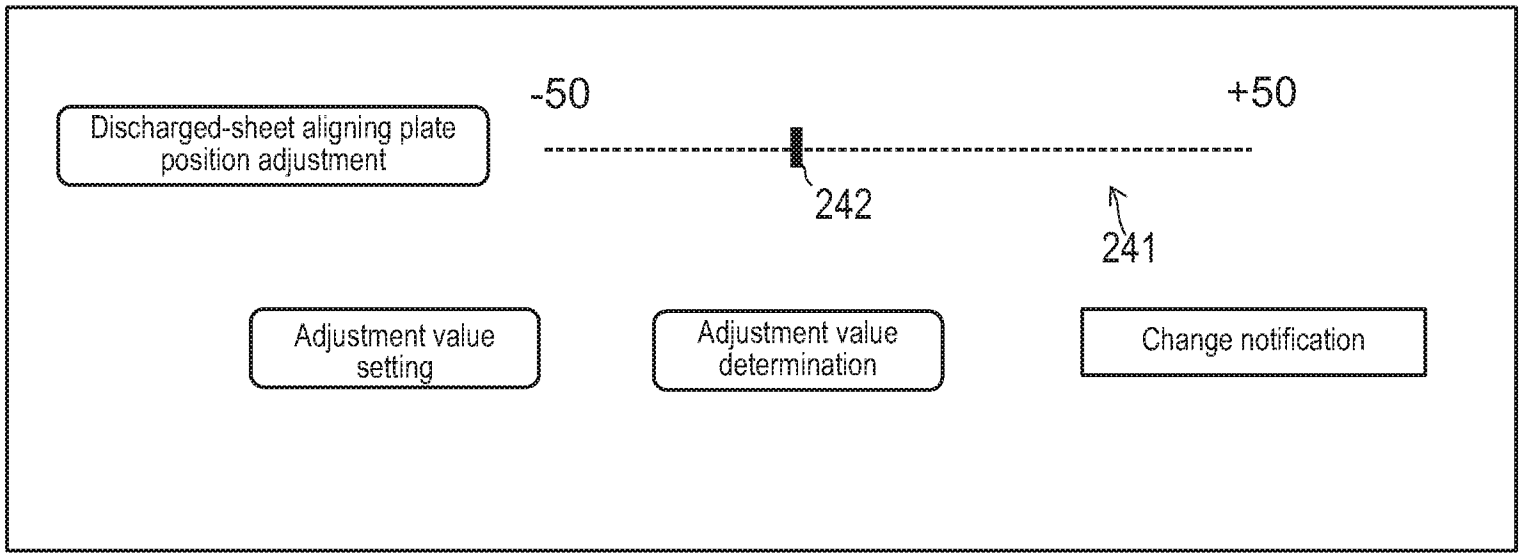
FIG. 4 is a diagram showing an operation screen for real-time adjustment.

FIG. 4 is a diagram showing an operation screen for real-time adjustment.

FIG. 4 shows the operation screen for real-time adjustment to perform the real-time adjustment for adjusting the position of discharged-sheet aligning plates provided to the sheet discharge tray 281. The discharged-sheet aligning plates include two aligning plates that sandwich temporarily both sides of the sheets S discharged onto the sheet discharge tray 281, wherein the both sides of the sheets are arranged in parallel to a sheet discharging direction of the sheet S. The discharged-sheet aligning plates sandwich the both sides of the sheets S so that the discharged sheets S are aligned on the sheet discharge tray 281. By adjusting the respective positions of the discharged-sheet aligning plates (the position of the discharged-sheet aligning plate) when the discharged-sheet aligning plates sandwich the sheets S, the alignment accuracy of the sheets S can be improved. For example, the size of the sheet S may be slightly changed due to the quantity of the toner of a toner image formed on the sheet S and the fixing condition of the toner image. In such a case, by adjusting the positions of the discharged-sheet aligning plates, the alignment accuracy of the sheets S can be improved.

On the operation screen for the real-time adjustment, as examples of adjustment items, "discharged-sheet aligning plate position adjustment" is displayed. When the user notices minor misalignment of the sheets S discharged during the executing of the post processing by the print job, by displaying the operation screen of real-time adjustment for adjusting the positions of the discharged-sheet aligning plates on the operating display 140, the user can issue the instruction to start the adjustment of the position of the discharged-sheet aligning plates, which is one of the post processing conditions.

The user can input the adjustment value of the positions of the discharged-sheet aligning plate by the position of a knob 242 of a slide bar 241. An adjustable range of the adjustment value of the post processing condition by the slide bar 241 is −50 to +50, and an adjustment unit can be set to 1. For example, in the case where the post processing condition is the position of the discharged-sheet aligning plate, the adjustable range of −50-+50 can correspond to an adjustable range of −50 mm to +50 mm for the position of each of the alignment plates when the discharged-sheet aligning plates sandwich the sheets S therebetween. In this case, when the position of the adjustment value by the slide bar 241 is 0, the distance between the two alignment plates when the delivered-sheet aligning plates sandwich the sheets S therebetween, is equal to the width of the sheets S in the direction perpendicular to the sheet discharging direction of the sheet S. An instruction to set the adjustment values of the post processing condition by the user is performed by selecting an "adjustment value setting" button by the user. By selecting the "adjustment value setting" button, the adjustment value of the position of the discharged-sheet aligning plate input by the slide bar 241 is set. At the time of setting the adjustment value of the position of the discharged-sheet aligning plate, the controller 110 transmits control signals to the post processing apparatus 200. Thereby, the position of the discharged-sheet aligning plate of the post processing apparatus 200 is reflected to the set adjustment value. When the position of the discharged-sheet aligning plate of the post processing apparatus 200 is reflected to the set adjustment value, a "change notification" button blinks several times, thereby the change notification of the post processing condition is performed. With the blinking of the "change notification" button, the user can recognize that the position of the discharged-sheet aligning plate of the post processing apparatus 200 has been reflected to the set adjustment value. Moreover, the sheets S discharged after the blinking of the "change notification" button, can be confirmed as the sheets S having been subjected to the post processing of sheet alignment by the discharged-sheet aligning plates after the adjustment. The user confirms the alignment accuracy of the sheets S having been subjected to the post processing of sheet alignment based on the post processing condition after the adjustment, and then, can change the adjustment value of the position of the discharged-sheet aligning plate based on the confirmation result. The change of the adjustment value of the position of the discharged-sheet aligning plate can be performed by inputting the adjustment value of the position of the discharged-sheet aligning plate after the changing with the slide bar 241 and by issuing the setting instruction for the adjustment value of the post processing condition by selecting the "adjustment value setting" button.

When the user has selected a "adjustment value determination" button so as to issue a determination instruction for the adjustment value of the position of the discharged-sheet aligning plate, the controller 110 determines the adjustment value of the position of the discharged-sheet aligning plate set immediately before, as the adjustment value of the position of the discharged-sheet aligning plate. In the case where the user has confirmed that minor defects in alignment accuracy have been eliminated on the sheets S having been subjected to the post processing of sheet alignment based on the adjustment value of the position of the discharged-sheet aligning plate set immediately before, the user can determine the adjustment value of the position of the discharged-sheet aligning plate by selecting the "adjustment value determination" button. After the adjustment value for the position of the discharged-sheet aligning plate has been determined, the controller 110 finishes the interval widening control. Thereby, the interval between the sheets S on the sheet conveyance passage 161, 162 is controlled to the usual interval before the interval widening control.

Post Processing Apparatus

The post processing apparatus 200 includes a controller 210, a memory 220, a communicator 230, an operating display 240, a sheet conveyor 250, a center folder 260, a side stitcher 270, and a discharger 280. The above devices are connected with each other via bus 290 to exchange signals. The post processing apparatus 200 constitutes a post processor. Each of the controller 210, the memory 220, the communicator 230, the operating display 240, and the sheet conveyor 250 has the same function of the corresponding constitution device of the image forming apparatus. Accordingly, duplicate description are omitted or simplified.

The controller 110 performs control for each of the above devices and various kinds of arithmetic processing in accordance with programs. Furthermore, the controller 210 controls the sheet conveyor 250, the center folder 260, the side stitcher 270, and the discharger 280 based on the instructions from the controller 110 of the image forming apparatus 100.

The sheet conveyor 250 includes sheet conveyance passages 251 to 253, a plurality of conveyance roller pairs disposed along the sheet conveyance passages 251 to 253, and motors (not-illustrated) to drive these conveyance roller pairs. The sheet conveyor 250 constitutes a conveyor.

The sheets S input from the image forming apparatus 100 to the sheet conveyance passage 251 are conveyed to a downstream side branched from the sheet conveyance passage 251 so as to be subjected to the post processing of center folding or side stitching.

The center folder 260 includes a sheet stacker 261 and a folding blade 262. The leading end (vertically downward side) of each set (bundle) of sheets S conveyed and placed on the sheet stacker 261 of the center folder 260 comes in contact with the sheet stacker 261, and then, stops. The intersection point between the set of sheets S and the locus of the folding blade 262 projected in the vertical direction toward the surface of the set of sheets S placed on the sheet stacker 261, becomes a center folding position. The sheet stacker 261 moves up and down correspondingly to the size of sheets such that the above intersection point becomes the center position of the sheets. Moreover, the stop position of the sheet stacker 261 is finely adjusted in the vertical direction so as to adjust the post processing condition, thereby it is possible to adjust the position of the center folding. The adjustment timing of the center folding position for the set of sheets S in the post processing of such center folding is a timing at which the leading sheet on the most downstream side in the conveyance direction among the sheets S included in the set has been conveyed to the sheet stacker 261. The set of sheets S placed on the sheet stacker 261 is pushed out by the movable folding blade 262 such that the center portion becomes the lead. The set of sheets S which is pushed-our is conveyed from the sheet conveyance passage 253 on the downstream side toward the discharger 280.

The side stitcher 270 includes the sheet stacker 261 and a stapler 271. The sheet stacker 261 may also serve as the component of the center folder 260. The leading end of the set of sheets S conveyed and placed on the sheet stacker 261 comes in contact with the sheet stacker 261, and then, stops. The set of sheets S placed on the sheet stacker 261 is subjected to side stitching by the stapler 271. The sheet stacker 261 moves up and down correspondingly to the size of sheets and the position of side stitching such that the side stitching is performed at the desired position of the side stitching. The stop position of the sheet stacker 261 is finely adjust in the vertical direction so as to adjust the post processing condition, thereby it is possible to adjust the position of the side stitching. The adjustment timing of the side stitching position for the set of sheets S in the post processing of such side stitching is a timing at which the trailing sheet on the most upstream side in the conveyance direction among the sheets S included in the set has been conveyed to the sheet stacker 261 (that is, a timing at which all the sheets S included in the set have been placed). After the set of the sheets S placed on the sheet stacker 261 has been subjected to the side stitching, the set of the sheets S is conveyed from the sheet conveyance passage 253 on the downstream side toward the discharger 280.

Hereinafter, an embodiment of the interval widening control and the adjustment of the post processing condition will be described.

Figure 5:
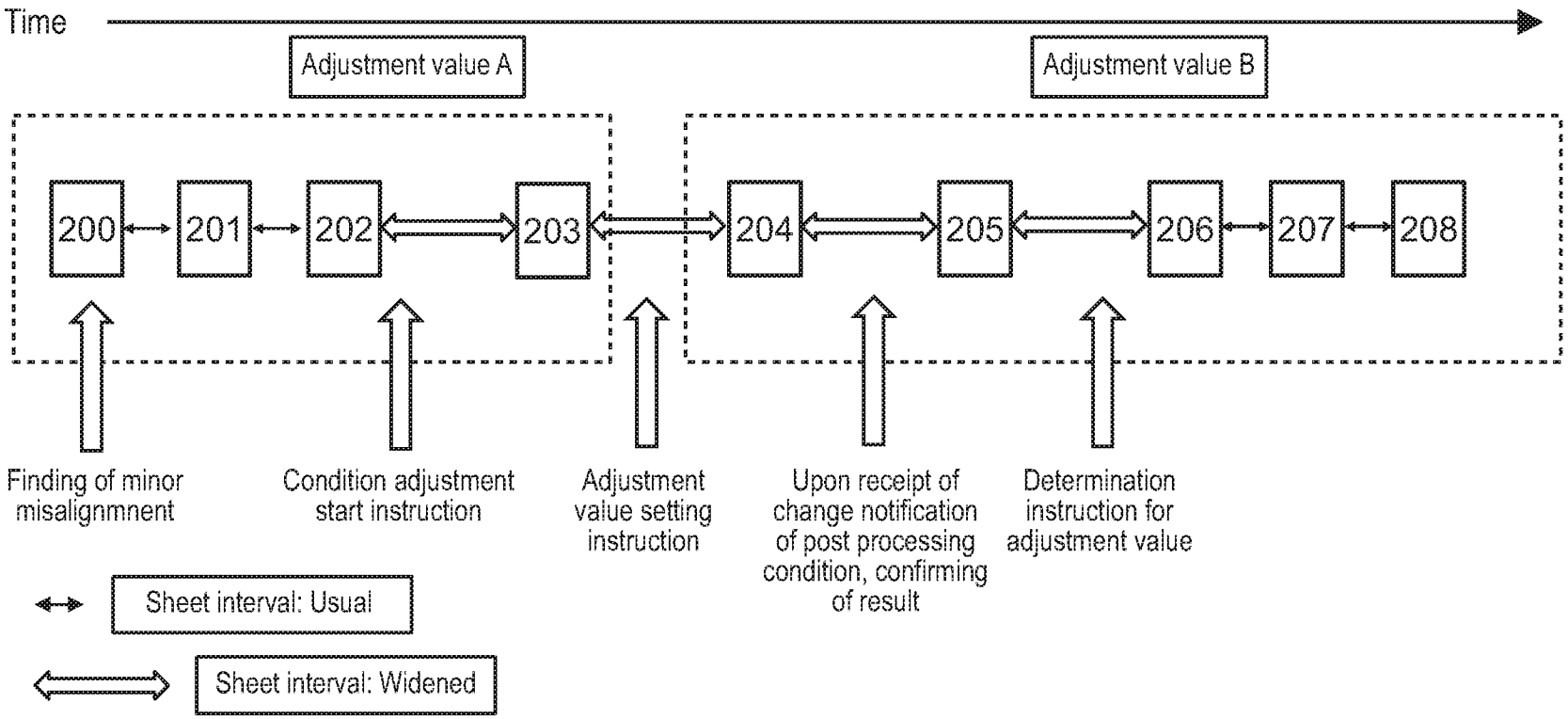
FIG. 5 is an explanatory diagram showing an outline of interval widening control and adjustment of post processing condition according to the first embodiment.

Interval Widening Control and Adjustment of Post Processing Condition According to First Embodiment FIG. 5 is an explanatory diagram showing an outline of the interval widening control and the adjustment of the post processing condition according to the first embodiment.

In the present embodiment, the interval widening control is performed in the case where, when sheets S are discharged from the post processing apparatus 200, the post processing of sheet alignment is performed for each of sheets S. The number of sheets included in each set of sheets S is one, and image formation and post processing are performed for the sheet S of 1000 sets. In the following description, in order to make the description simple, it is assumed that the instruction by the user, such as the setting instruction for the adjustment value of post processing condition, the reflection of the adjustment value of post processing condition to the post processing apparatus 200, and the confirmation of the results of post processing based on the changed post processing condition are performed in comparatively short time. However, the time required for the above action may be varied depending on the apparatus performance of each of the image forming apparatus 100 and the post processing apparatus 200 and the number of users.

Each of sheets S shown in FIG. 5 is the sheet S for which the post processing has been finished at the time corresponding to the time axis in the post processing apparatus 200 (more in detail, the sheet S at a moment when the post processing for the sheet S has been finished in the post processing apparatus 200). In the case where the user notices minor misalignment on the 200th sheet S during the executing of the print job, after the post processing for the 202th sheet has been finished, before the post processing for the 203th sheet is finished, it is possible to issue the condition adjustment start instruction. Thereby, the interval widening control is performed from the 203th sheet. In FIG. 5, a usual sheet interval not applied with the interval widening control is indicated with a double arrow mark of a solid black line, and a widened sheet interval having been applied with the interval widening control is indicated with a double arrow mark of an outlined line. The usual sheet interval is, for example, 0.5 to 1.0 seconds in terms of the time interval of the sheet S for which the post processing is finished. The widened sheet interval having been applied with the interval widening control is, for example, 3.0 to 5.0 seconds in terms of the time interval of the sheet S in which the post processing is finished. After the post processing for the 203th sheet S has been finished, before the post processing for the 204th sheet S is finished, it is possible to issue the setting instruction of the adjustment value of the post processing condition in order to set the adjustment value of the post processing condition to B. Then, the adjustment value of the post processing condition in the post processing apparatus 200 can be changed from the adjustment value A to the adjustment value B. Thereby, the post processing based on the post processing condition of the adjustment value B is performed from the 204th sheet S. By receiving the change notification of the post processing condition, the user recognizes that the 204th sheet S has been subjected to the post processing based on the post processing condition of the adjustment value B after the changing. As a result of confirming the alignment accuracy of the 204th sheet S by the user, in the case where minor misalignment on the sheets S is eliminated, before the post processing for the 206th sheet S is finished, the user can issue the determination instruction of the adjustment value B. Thereby, in the post processing for the 207th sheet S and the following sheets S after the 207th sheet S, the adjustment value of the post processing condition is determined to the adjustment value B. Then, from the 207th sheet S, the sheet interval with the preceding sheet returns to the sheet interval before the interval widening control.

Figure 6:
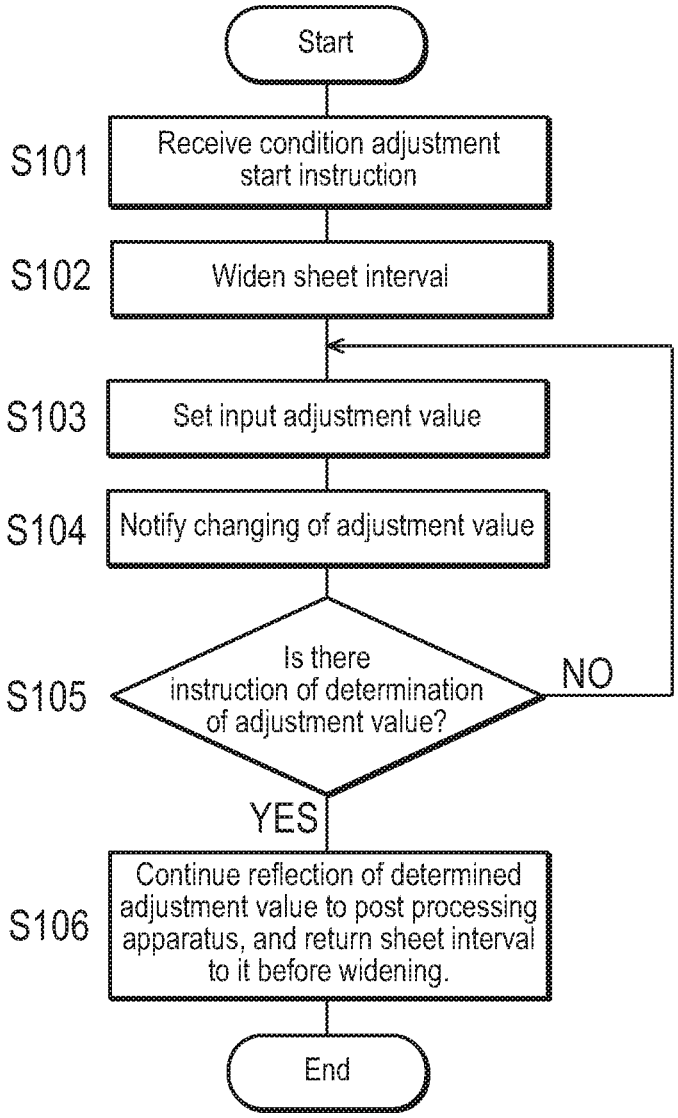
FIG. 6 is a flow chart showing operation of the image forming apparatus according to the embodiment of the present invention.

FIG. 6 is a flow chart showing the operation of the image forming apparatus in the present embodiment. This flow chart is performed by the controller 110 of the image forming apparatus 100 in accordance with programs.

When the condition adjustment start instruction by the user has been received in the operating display 140, the controller 110 determines that the condition adjustment start instruction has been issued (S101).

When the controller 110 has determined that the condition adjustment start instruction has been issued, for the sheet S that is conveyed on the conveyance passages 161, 162 and is a target of the interval widening control, the controller 110 performs the interval widening control to widen the interval between the target sheet S and the preceding sheet S (S102).

When the setting instruction of the adjustment value of the post processing conditions is input by the user in the operating display 140, the controller 110 sets the adjustment values of the post processing condition (S103). At the time of setting the adjustment value of the post processing condition, the controller 110 transmits control signals including the adjustment value of the post processing condition to the post processing apparatus 200. Thereby, the adjustment value of the post processing condition based on the setting instruction of the adjustment value of the post processing condition is reflected to the post processing apparatus 200.

The controller 110 performs the change notification of the post processing condition (S104).

The controller 110 repeats Step S103 and Step S104 until the determination instruction for the adjustment value of the post processing condition is input by the user in the operating display 140 (S105: NO).

When the determination instruction for the adjustment value of the post processing condition has been input by the user in the operating display 140 (S105: YES), the controller 110 determines the adjustment value of the post processing condition currently being set. Thereby, the reflection of the post processing condition based on the determined adjustment value to the post processing apparatus 200 is continued. Then, the controller 110 finishes the interval widening control, and returns the sheet interval of the sheet S being conveyed on the conveyance passage 161, 162 with the preceding sheet to the sheet interval before the interval widening control (S106).

Figure 7:
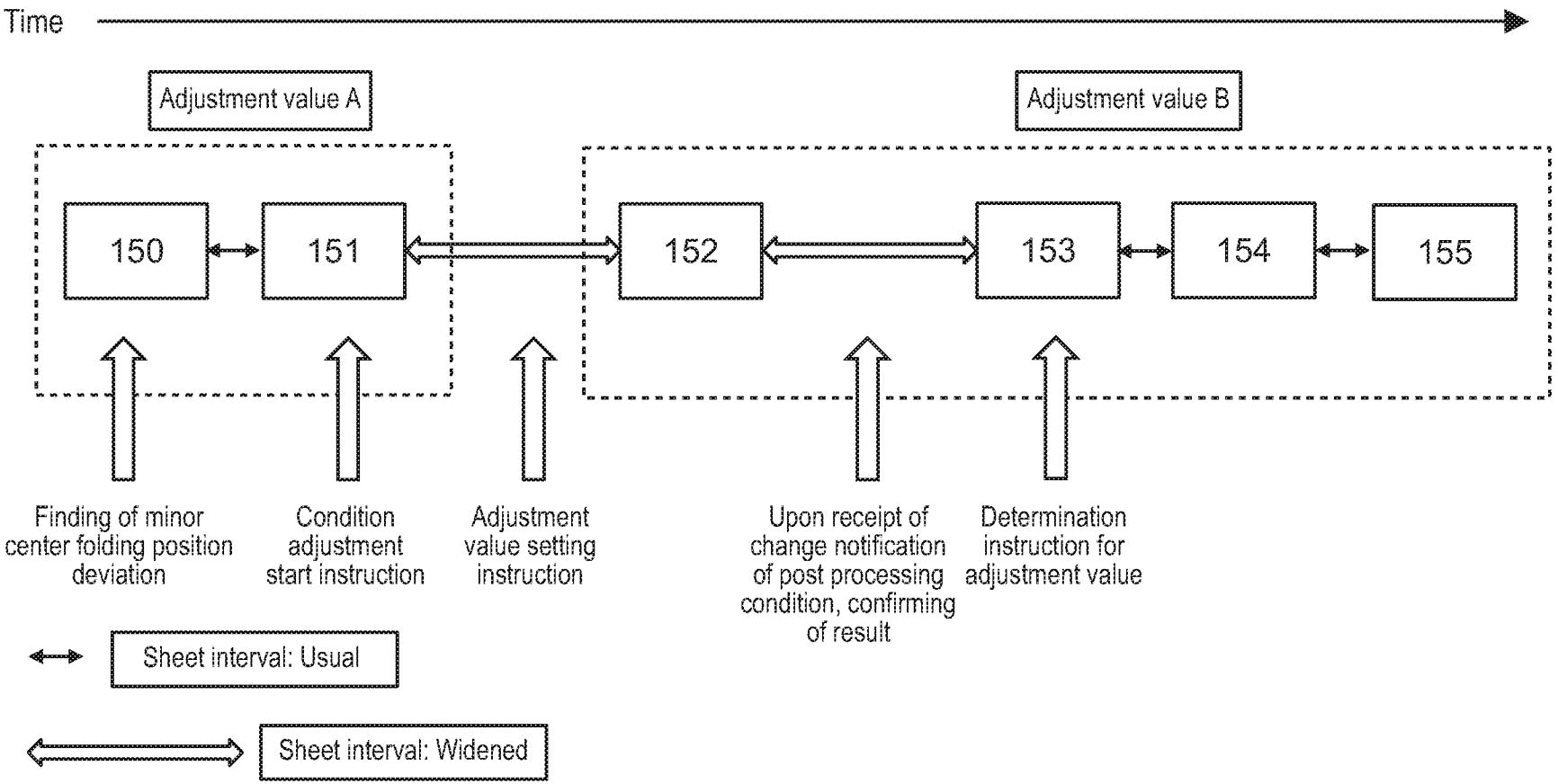
FIG. 7 is an explanatory diagram showing an outline of interval widening control and adjustment of post processing condition according to the second embodiment.

Interval Widening Control and Adjustment of Post Processing Condition According to Second Embodiment FIG. 7 is an explanatory diagram showing an outline of the interval widening control and the adjustment of the post processing condition according to the second embodiment.

In the present embodiment, the interval widening control is performed in the case where the post processing of center folding is performed for each set of sheets S. The number of sheets included in each set of sheets S is two, and image formation and post processing are performed for 300 sets. Since points other than this are the same as those of the first embodiment, the overlapping explanation is omitted or simplified.

Each set (bundle) of sheets S shown in FIG. 7 is the set for which the post processing has been finished at the time corresponding to the time axis in the post processing apparatus 200. In the case where the user notices minor positional deviation on the center folding position of the 150th set during the executing of the print job, while the post processing for the 151th set is being performed, it is possible to issue the condition adjustment start instruction. Thereby, the interval widening control is performed from the 152th set. In the interval widening control, control to widen an interval between the leading sheet S on the most downstream side in the conveyance direction among the sheets S included in the set of the target of the interval widening control and the trailing sheet S on the most upstream side in the conveyance direction among the sheets S included in the set preceding the set of the target of the interval widening control, is performed. In FIG. 7, the usual set interval not applied with the interval widening control is indicated with the double arrow mark of a solid black line, and the widened set interval having been applied with the interval widening control is indicated with the double arrow mark of an outlined line. After the post processing for the 151th set has been finished, before the post processing for the 152th set is finished, it is possible to issue the setting instruction of the adjustment value of the post processing condition in order to set the adjustment value of the post processing condition to B. Then, the adjustment value of the post processing condition in the post processing apparatus 200 can be changed from the adjustment value A to the adjustment value B. Thereby, the post processing based on the post processing condition of the adjustment value B is performed from the 152th set. By receiving the change notification of the post processing condition, the user recognizes that the 152th set has been subjected to the post processing based on the post processing condition of the adjustment value B after the changing. As a result of confirming the center folding position of the 152th set by the user, in the case where minor positional deviation of the center folding position on the set is eliminated, while the post processing for the 153th set is being performed, the user can issue the determination instruction for the adjustment value B. Thereby, in the post processing for the 153th set and the following sets after the 153th set, the adjustment value of the post processing condition is determined to the adjustment value B. Then, from the 154th set, the set interval with the preceding set returns to the set interval before the interval widening control.

Figure 8:
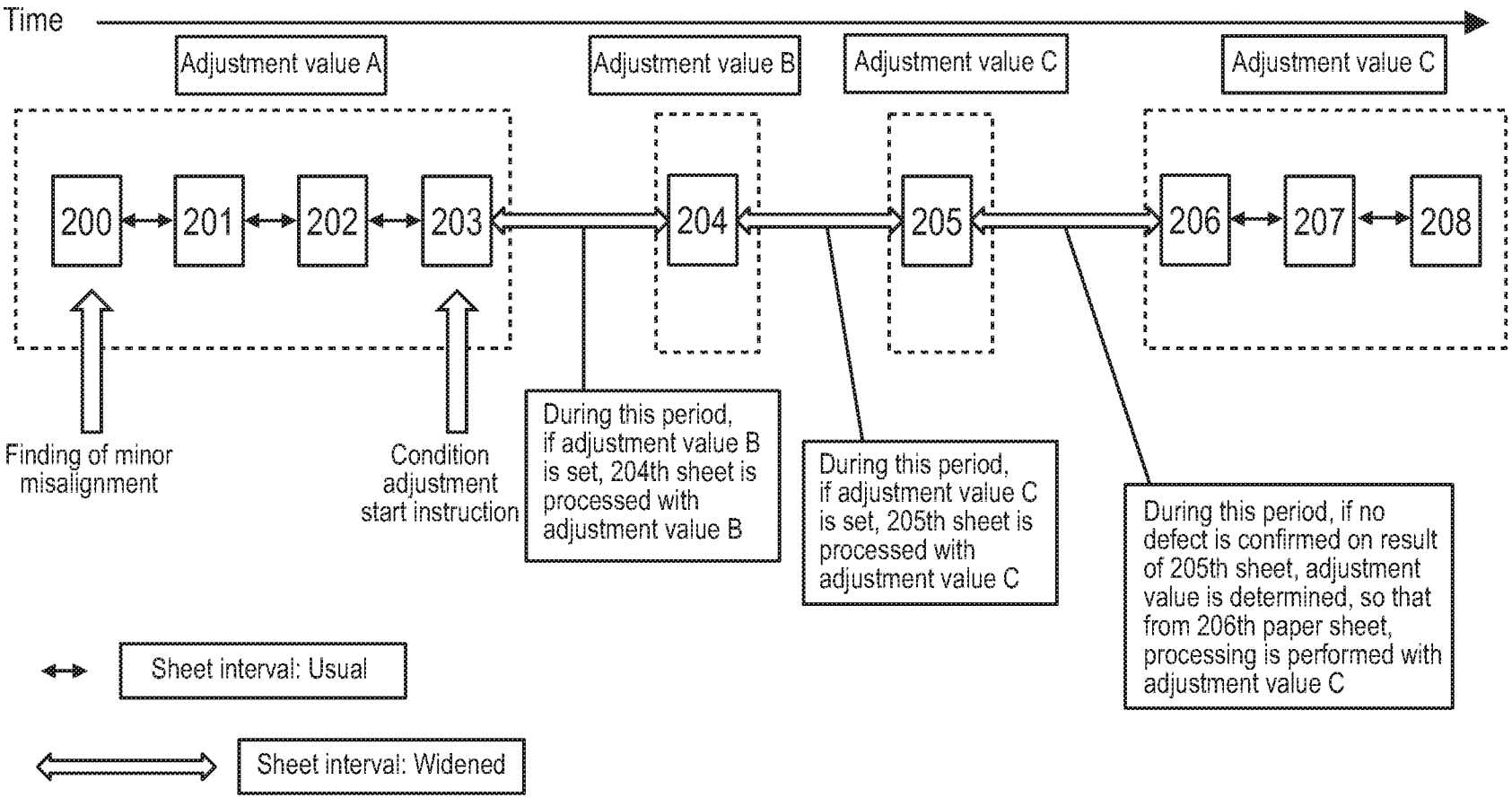
FIG. 8 is an explanatory diagram showing an outline of interval widening control and adjustment of post processing condition according to the third embodiment.

Interval Widening Control and Adjustment of Post Processing Condition According to Third Embodiment FIG. 8 is an explanatory diagram showing an outline of the interval widening control and the adjustment of the post processing condition according to the third embodiment.

In the present embodiment, when sheets S are discharged from the post processing apparatus 200, the post processing of sheet alignment is performed for each sheet S. The number of sheets included in each set of sheets S is one, and image formation and post processing are performed for the sheet S of each of 1000 sets. A point different between the present embodiment and the first embodiment is that, in the present embodiment, the setting of the adjustment value of the post processing condition is performed plural times for each sheet S before the adjustment value is determined. Moreover, since the setting of the adjustment value of the post processing condition is performed for each sheet S, the sheet interval widened by the interval widening control in the present embodiment may be made larger than the sheet interval in the first embodiment. More specifically, in the present embodiment, the sheet interval widened by the interval widening control is, for example, 20.0 to 30.0 seconds in terms of the time interval in which the post processing is finished. Since the other points are the same with those in the first embodiment, the duplicate description is omitted or simplified.

Each of sheets S shown in FIG. 8 is the sheet S for which the post processing has been finished at the time corresponding to the time axis in the post processing apparatus 200. In the case where the user notices minor misalignment on the 200th sheet S during the executing of the print job, while the post processing for the 203th sheet is being performed, it is possible to issue the condition adjustment start instruction. Thereby, the interval widening control is performed from the 204th sheet. After the post processing for the 203th sheet S has been finished, before the post processing for the 204th sheet S is finished, it is possible to issue the setting instruction of the adjustment value of the post processing condition in order to set the adjustment value of the post processing conditions to B. Then, the adjustment value of the post processing condition in the post processing apparatus 200 can be changed from the adjustment value A to the adjustment value B. Thereby, the post processing based on the post processing condition of the adjustment value B is performed for the 204th sheet S. By receiving the change notification of the post processing condition, the user recognizes that the 204th sheet S has been subjected to the post processing based on the post processing condition of the adjustment value B after the changing. As a result of confirming the alignment accuracy of the 204th sheet by the user, in the case where minor misalignment on the sheets S is not eliminated, before the post processing for the 205th sheet S is finished, it is possible to issue the setting instruction for the post processing condition in order to set the setting value of the post processing condition to the adjustment value C. Then, the adjustment value of the post processing condition in the post processing apparatus 200 can be changed from the adjustment value B to the adjustment value C. Thereby, the post processing based on the post processing condition of the adjustment value C is performed for the 205th sheet S. By receiving the change notification of the post processing conditions, the user recognizes that the 205th sheet S has been subjected to the post processing based on the post processing conditions of the adjustment value C after the changing. As a result of confirming the alignment accuracy of the 205th sheet by the user, in the case where minor misalignment on the sheets S is eliminated, before the post processing for the 206th sheet S is finished, the user can issue the determination instruction for the adjustment value C. Thereby, in the post processing for the 206th sheet S and the following sheets S after the 206th sheet S, the adjustment value of the post processing condition is determined to the adjustment value C. Then, from the 207th sheet S, the sheet interval with the preceding sheet returns to the sheet interval before the interval widening control.

In the present embodiment, as mentioned above, the sheet interval widened by the interval widening control is made larger comparatively. For this reason, in order to suppress the decrease of productivity as much as possible, after the setting instruction for the adjustment value of the post processing condition has been issued, the conveyance speed of the sheet S may be increased.

Figure 9:
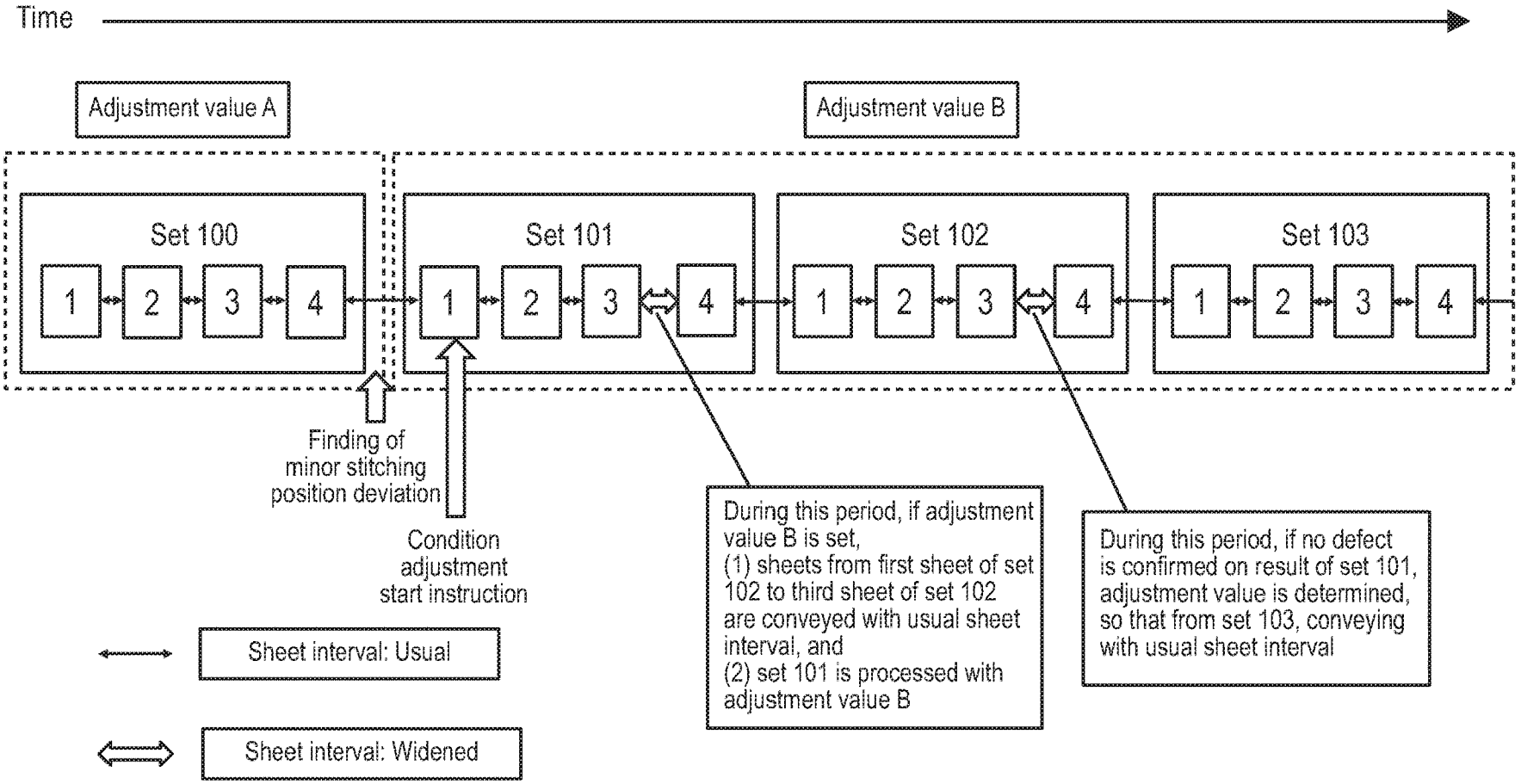
FIG. 9 is an explanatory diagram showing an outline of interval widening control and adjustment of post processing condition according to the fourth embodiment.
Figure 10:
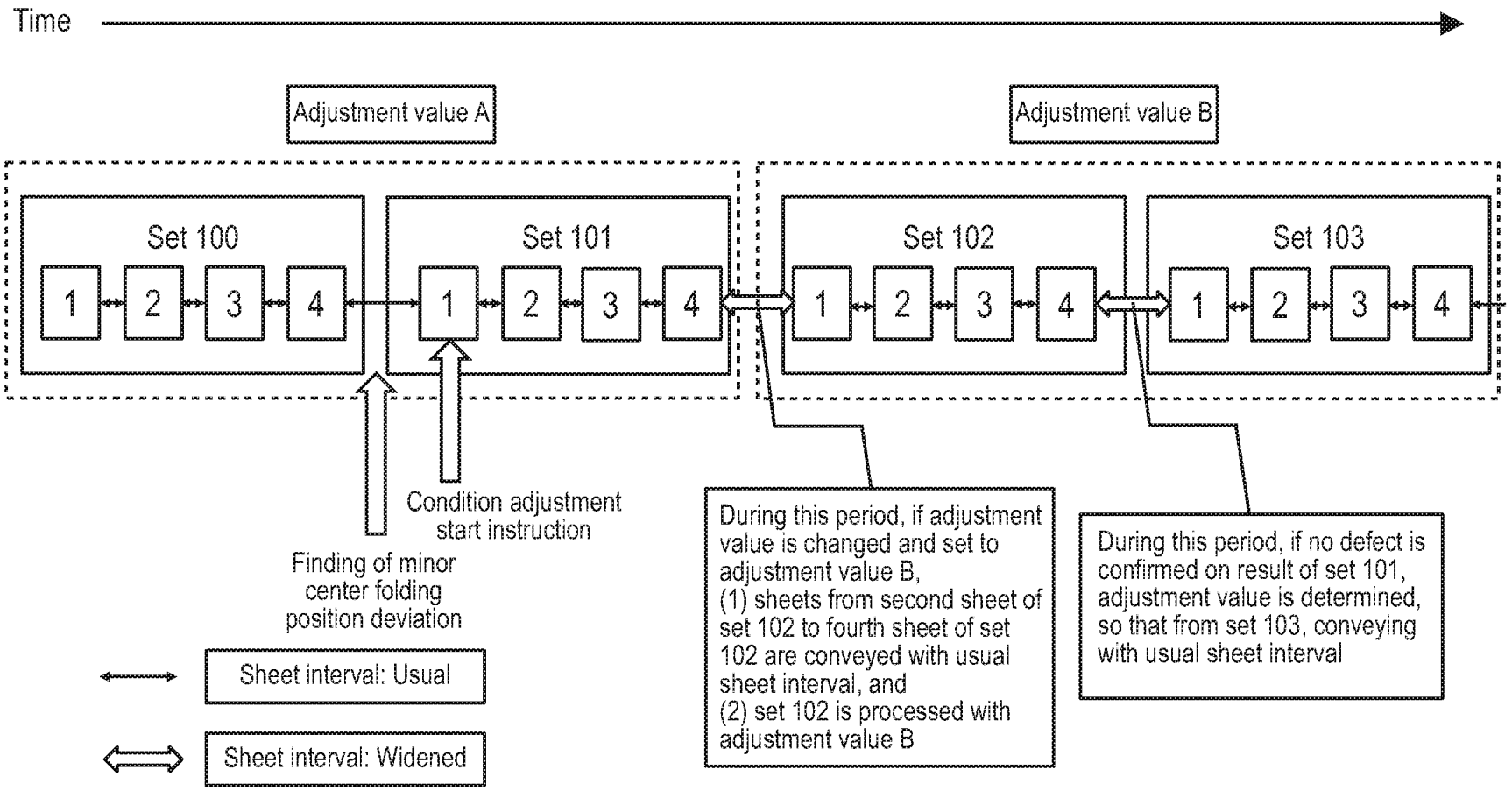
FIG. 10 is an explanatory diagram showing an outline of interval widening control and adjustment of post processing condition according to the fourth embodiment.

Interval Widening Control and Adjustment of Post Processing Condition According to Fourth Embodiment Each of FIGS. 9 and 10 is an explanatory diagram showing an outline of the interval widening control and the adjustment of the post processing condition according to the fourth embodiment.

In the present embodiment, the post processing of side stitching or center folding is performed for each set of sheets S. The number of sheets included in each set of sheets S is four, and image formation and post processing are performed for 200 sets. A point different between the present embodiment and the second embodiment is that, in the present embodiment, in accordance with a mode of adjusting timing of the sheet S in the post processing for each set of sheets S, the sheets S included in the set being the target of the interval widening control performed of each set is changed. The mode of adjusting timing of the sheet S in the post processing includes two modes. One mode is a first post processing mode to perform the adjustment of the post processing at a timing when the trailing sheet S on the most upstream in the conveyance direction among the sheets S included in the set has been conveyed to the post processing apparatus 200. The post processing in the first post processing mode includes, for example, the side stitching. Moreover, the adjustment of the sheet S in the post processing in the first post processing mode includes, for example, the adjustment of the side stitching position at the time of the side stitching and the alignment of the set of the sheets S at the time of the side stitching. Another mode is a second post processing mode to perform the adjustment of the sheets S in the post processing at a timing when the leading sheet on the most downstream in the conveyance direction among the sheets S included in the set has been conveyed to the post processing apparatus 200. The post processing in the second post processing mode includes, for example, the center folding. Moreover, the adjustment of the sheet S in the post processing in the second post processing mode includes, for example, the adjustment of the center folding position at the time of the center folding. Since the other points are same with those in the second embodiment, the duplicate description for them is omitted or simplified.

FIG. 9 shows an outline of the interval widening control and the adjustment of the post processing condition in the first post processing mode. The post processing for which the post processing condition is adjusted, is the side stitching.

Each set shown in FIG. 9 is the set for which the post processing has been finished at the time corresponding to the time axis in the post processing apparatus 200. In the case where the user notices minor positional deviation on the side stitching position of the 100th set during the executing of the print job, while the post processing for the leading sheet S of the 101th set is being performed, it is possible to issue the condition adjustment start instruction. Thereby, the interval widening control is performed from the 101th set. In the interval widening control in the first post processing mode, control to widen an interval between the trailing sheet S (the fourth sheet in the 101th set) and the preceding sheet, is performed. The sheets S from the first sheet S in the 102th set to the third sheet S in the 102th set are conveyed with the usual sheet interval. After the preceding sheet S (the third sheet S in the 101th set) immediately before the trailing sheet S in the 101th set has been conveyed to the post processing apparatus 200, before the trailing sheet S in the 101th set is conveyed to the post processing apparatus 200, it is possible to issue the setting instruction of the adjustment value of the post processing condition in order to set the adjustment values of the post processing condition to B. Then, the adjustment value of the post processing condition in the post processing apparatus 200 can be changed from the adjustment value A to the adjustment value B. Thereby, from the 101th set, the post processing based on the post processing condition of the adjustment value B is performed. By receiving the change notification of the post processing condition, the user recognizes that the 101th set has been subjected to the post processing based on the post processing condition of the adjustment value B after the changing. As a result of confirming the side stitching position of the 101th set by the user, in the case where minor positional deviation on the set is eliminated, the user can issue the determination instruction for the adjustment value B at the next timing. That is, after the preceding sheet S (the third sheet S of the 102th set) of the 102th set immediately before the trailing sheet S has been conveyed to the post processing apparatus 200, before the trailing sheet S of the 102th set is conveyed to the post processing apparatus 200, it is possible to issue the determination instruction for the adjustment value B. Thereby, in the post processing for the 102th set and the following sets after the 102th set, the adjustment value of the post processing condition is determined to the adjustment value B. Then, from the 103th set, the interval widening control is cancelled, and the sheet interval of all the sheets S included in each set is controlled to the usual sheet interval.

FIG. 10 shows an outline of the interval widening control and the adjustment of the post processing conditions in the second post processing mode. The post processing for which the post processing condition is adjusted, is the center folding.

In the case where the user notices minor positional deviation on the center folding position of the 100th set during the executing of the print job, while the post processing for the leading sheet S of the 101th set is being performed, it is possible to issue the condition adjustment start instruction. Thereby, from the 102th set, the interval widening control is performed. In the interval widening control in the second post processing mode, control to widen an interval between the leading sheet S (the first sheet of each set) and the preceding sheet, is performed. The sheets S from the second sheet S of the 102th set to the fourth sheet S of the 102th set are conveyed with the usual sheet interval. After the trailing sheet S (the fourth sheet S of the 101th set) of the 101th set has been conveyed to the post processing apparatus 200, before the leading sheet S of the 102th set is conveyed to the post processing apparatus 200, it is possible to issue the setting instruction of the adjustment value of the post processing condition in order to set the adjustment values of the post processing condition to B. Then, the adjustment value of the post processing condition in the post processing apparatus 200 can be changed from the adjustment value A to the adjustment value B. Thereby, from the 102th set, the post processing based on the post processing condition of the adjustment value B is performed. By receiving the change notification of the post processing condition, the user recognizes that the 102th set has been subjected to the post processing based on the post processing condition of the adjustment value B after the changing. As a result of confirming the center folding position of the 102th set by the user, in the case where minor positional deviation on the center folding position of the set is eliminated, the user can issue the determination instruction for the adjustment value B at the next timing. That is, after the trailing sheet of the 102th set has been conveyed to the post processing apparatus 200, before the leading sheet S (the first sheet S of the 103th set) of the 103th set is conveyed to the post processing apparatus 200, it is possible to issue the determination instruction for the adjustment value B by the user. Thereby, in the post processing for the 103th set and the following sets after the 103th set, the adjustment value of the post processing condition is determined to the adjustment value B. Then, from the 103th set, the interval widening control is cancelled, and the sheet interval of all the sheets S included in each set is controlled to the usual sheet interval.

In the example of the interval widening control shown in each of FIG. 9 and FIG. 10, the interval widening control is performed for each set. This is because the type of the post processing condition set in the print setting included in the print job is made to perform the post processing for each set. In the print setting included in the print job, in the case where the type of the post processing condition to perform the post processing for each sheet S is set, the interval widening control is performed for each sheet included in the set. The type of the post processing condition to perform the post processing for each set includes the folding for each set and the stapling for each set. The type of the post processing condition to perform the post processing for each sheet included in the set, includes the aligning for each sheet and the punching for each recording medium.

In the example of the interval widening control and the adjustment of the post processing condition shown in FIG. 10, during a period after the trailing sheet S of the preceding 101th set has been conveyed to the post processing apparatus 200 until the leading sheet S of the succeeding 102th set is conveyed to the post processing apparatus 200, the setting instruction of the adjustment value B of the post processing condition is issued only once. However, for example, during a period after the trailing sheet S of the preceding 102th set has been conveyed to the post processing apparatus 200 until the leading sheet S of the succeeding 103th set is conveyed to the post processing apparatus 200, the setting instruction for the adjustment value C of the post processing condition may be issued. In this case, the 103th set is subjected to the post processing based on the post processing condition of the adjustment value C.

Figure 11:
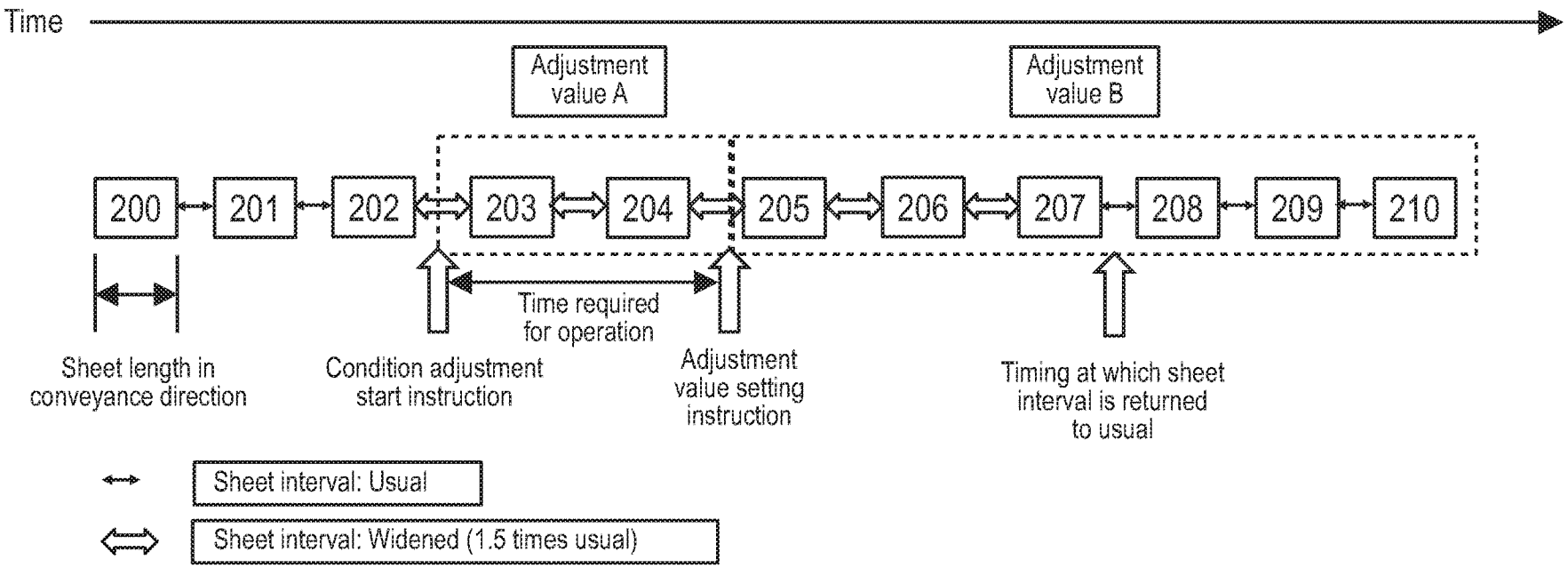
FIG. 11 is an explanatory diagram showing an outline of interval widening control and adjustment of post processing condition according to the fifth embodiment.
Figure 12:
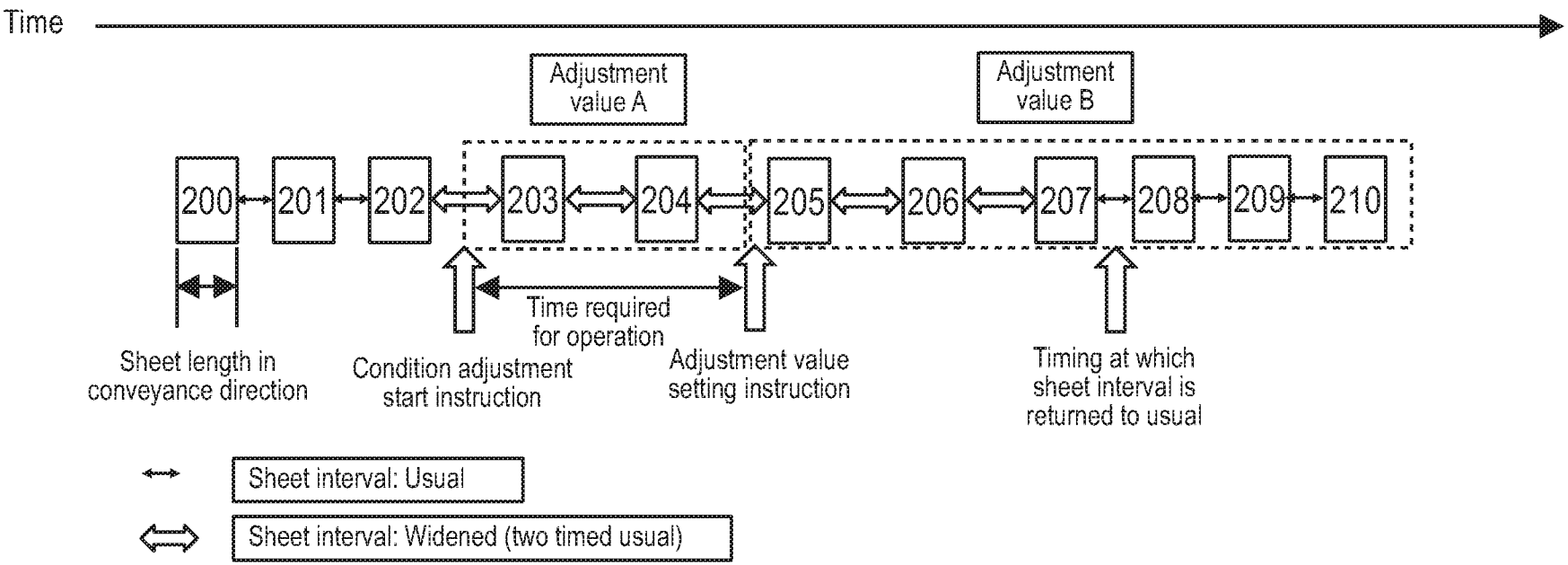
FIG. 12 is an explanatory diagram showing an outline of interval widening control and adjustment of post processing condition according to the fifth embodiment.

Interval Widening Control and Adjustment of Post Processing Condition According to Fifth Embodiment Each of FIG. 11 and FIG. 12 is an explanatory illustration showing an outline of the interval widening control and the adjustment of the post processing condition according to the fifth embodiment. A point different between the present embodiment and the first embodiment is a that, in the present embodiment, the sheet interval widened in the interval widening control is changed correspondingly to the orientation of the sheet S with respect to the conveyance direction. Since the other points are the same with those in the first embodiment, the duplicate description is omitted or simplified.

In the present embodiment, when sheets S are discharged from the post processing apparatus 200, the post processing of sheet alignment is performed for each of the sheet S. The number of sheets included in each set of sheets S is one, and image formation and post processing are performed for the sheet S of each of 1000 sets.

Each of sheets S of an A4 size shown in FIG. 11 is the sheet S for which the post processing has been finished at the time corresponding to the time axis in the post processing apparatus 200. The orientation of the sheet S to the conveyance direction is the orientation in which the direction of the short side of the sheet S is made perpendicular to the conveyance direction. Hereinafter, the sheet S of the A4 sheet size conveyed with the orientation in which the direction of the short side of the sheet S becomes perpendicular to the conveyance direction, is called "A4S".

On the other hand, in each of sheets S of the A4 size shown in FIG. 12, the orientation of the sheet S to the conveyance direction is the orientation in which the direction of the long side of the sheet S is made perpendicular to the conveyance direction. Hereinafter, the sheet S of the A4 sheet size conveyed with the orientation in which the direction of the long side of the sheet S becomes perpendicular to the conveyance direction, is called "A4L".

As shown in FIG. 11 and FIG. 12, after the post processing for the 202th sheet has been finished, before the post processing for the 203th sheet is finished, it is possible to issue the condition adjustment start instruction. Thereby, from the 203th sheet, the interval widening control is performed. Herein, when the interval widening control is not performed, the usual sheet interval for each of the case of the sheet of A4S and the case of the sheet of A4L is controlled to the same standard interval D. On the other hand, in the interval widening control, in the case where the sheet is A4S, for the sheet becoming the target of the interval widening control, the interval with the preceding sheet is made 1.5 times the standard interval D. In the case where the sheet is A4L, for the sheet becoming the target of the interval widening control, the interval with the preceding sheet is made 2.0 times the standard interval D.

After the post processing for the 204th sheet S has been finished, before the post processing for the 205th sheet S is finished, it is possible to issue the setting instruction of the adjustment value of the post processing condition in order to set the adjustment value of the post processing condition to B. Then, the adjustment value of the post processing condition in the post processing apparatus 200 can be changed from the adjustment value A to the adjustment value B. Thereby, from the 205th sheet S, the post processing based on the post processing condition of the adjustment value B is performed. When the user issues the determination instruction for the adjustment value B, the adjustment value of the post processing condition is determined to the adjustment value B. Then, from the 208th sheet S, the sheet interval with the preceding sheet can return to the standard interval D before the interval widening control.

From the time when the user has issued the condition adjustment start instruction to the time when the user issues the instruction to set the adjustment value to the adjustment value B, time required for certain operations is necessary as time required for the operation by the user. For this reason, in the required time, even if the sheet interval is widened, the sheet S in which minor misalignment due to the post processing condition based on the adjustment value A is not eliminated, may be caused. As described above, in the case where the sheet S is A4S, the sheet interval at the time of the interval widening control is made 1.5 times the standard interval D, and in the case where the sheet S is A4L, the sheet interval at the time of the interval widening control is made 2.0 times the standard interval D. Thereby, between the case where the sheet S is A4S and the case where the sheet S is A4L, the number of sheets per unit time subjected to the post processing based on the post processing condition of the adjustment value A before the changing becomes almost the same. In FIG. 11 and FIG. 12, the sheets S having been subjected to the post processing based on the post processing condition of the adjustment value A before the changing within the time required for the operation are shown such that the sheets S are surrounded by a thick broken line. That is, between the case where the sheet S is A4S and the case where the sheet S is A4L, the number of the sheets S having been subjected to the post processing based on the post processing condition of the adjustment value A before the changing within the time required for the operation is the same two sheets (the 203th sheet S and the 204th sheet S). For this reason, in the case where the post processing is performed for sheets such as A4L in which the length of the sheet S in the conveyance direction is shorter, it becomes possible to suppress the increasing of the number of sheets S in which minor misalignment due to the post processing condition before the changing has been caused.

Each of the above embodiments has the following effects.

The control to widen the sheet interval with the preceding sheet is performed for the sheets being conveyed during real-time adjustment. Thereby, the amount of sheets S discharged with minor defects during the real-time adjustment can be reduced, and in addition, it is possible to easily confirm the sheets to which the setting change of adjustment value is reflected.

Furthermore, after the real-time adjustment has been started, the instruction of setting of the adjustment value of the post processing condition is received, and the post processing condition of the post processing apparatus is adjusted based on the instruction of setting of the adjustment value of the post processing condition. Thereby, while adjusting the post processing condition of the post processing apparatus, it is possible to easily confirm the sheets to which the setting change of adjustment value is reflected.

Furthermore, after the instruction to start adjustment of the post processing condition has been received, the interval widening control is performed by changing the conveyance speed of the sheet passing through the predetermined position on the conveyance passage from the first conveyance speed to the second conveyance speed slower than the first conveyance speed. Thereby, the interval widening control can be performed easily without adding equipment.

Furthermore, the determination instruction for the adjustment value of the post processing condition is received, and after the determination instruction has been received, the conveyance speed of the sheet passing through the predetermined position is returned from the second conveyance speed to the first conveyance speed. Thereby, the productivity of the printed matters in which the minor defects in the post processing have been eliminated by the real-time adjustment can be improved.

Furthermore, the second conveyance speed is changed in accordance with the predetermined condition to the second conveyance speed corresponding to the predetermined condition. Thereby, it is possible to suppress the increasing of the amount of sheets S discharged with minor defects due to the condition such as print setting of the print job during the real-time adjustment.

Furthermore, as the length of the sheet in the conveyance direction is shorter, the second conveyance speed is changed to the lower speed. Thereby, regardless of the orientation of the sheet with respect to the conveyance direction, it is possible to suppress the increasing of the amount of sheets S discharged with minor defects during the real-time adjustment.

Furthermore, as the basis weight of the sheet is smaller, the second conveyance speed is changed to the lower speed. Thereby, even if the rotation speed of the motor to control the conveyance speed of the sheet is constant, it is possible to suppress the increasing of the amount of sheets S discharged with minor defects during the real-time adjustment due to the deviation of the conveyance speed caused by the variation of the basis weight of the sheet.

Furthermore, as the number of sheets included in the set is smaller, the second conveyance speed is changed to the slower speed. Thereby, regardless of the number of sheets included in the set, it is possible to suppress the amount of sheets S discharged with minor defects during the real-time adjustment to the fixed amount.

Furthermore, as the time required for the post processing by the post processing apparatus is shorter, the second conveyance speed is changed to the slower speed. Thereby, regardless of the time required for the post processing by the post processing apparatus, it is possible to suppress the amount of sheets S discharged with minor defects during the real-time adjustment to a fixed amount.

Furthermore, in the case where the predetermined condition includes the plurality of predetermined conditions, the second conveyance speed is changed to the slowest speed among the second conveyance speeds corresponding to the respective predetermined conditions. Thereby, even in the case where the amount of sheets S delivered with defects during the real-time adjustment due to the plurality of conditions fluctuates, it is possible to suppress the amount of sheets S with the defects to the fixed amount or less.

Furthermore, after the instruction to start adjustment of the post processing condition has been received, the interval widening control is performed by stopping temporarily the sheet passing through the predetermined position on the conveyance passage at the predetermined position. Thereby, the interval widening control can be performed easily.

Furthermore, the above predetermined position is made the position of the registration rollers. Thereby, by utilizing the registration rollers, the interval widening control can be easily performed without adding equipment.

Furthermore, the determination instruction for the adjustment value of the post processing condition is received, and after the determination instruction has been received, the sheet passing through the above predetermined position is made to pass through without being stopped at the predetermined position. Thereby, the productivity of the printed matters in which the minor defects in the post processing have been eliminated by the real-time adjustment, can be improved.

Furthermore, the stopping time at the time of stopping temporarily the sheet passing through the above predetermined position at the predetermined position after the instruction to start the adjustment of the post processing condition has been received, is changed to the stopping time corresponding to the predetermined condition. Thereby, it is possible to suppress the increasing of the amount of sheets discharged with minor defects during the real-time adjustment due to the condition such as the print setting of the print job.

Furthermore, the above predetermined condition is made the condition relating to at least one of the length of the sheet in the conveyance direction, the basis weight of the sheet, the number of sheets included in the set, and time required for the post processing by the post processing apparatus. Thereby, it is possible to suppress effectively the increasing of the amount of sheets discharged with minor defects during the real-time adjustment due to the specific condition.

Furthermore, as the length of the sheet in the conveyance direction is shorter, the above stopping time is changed to longer time. Thereby, regardless of the orientation of the sheet with respect to the conveyance direction, it is possible to suppress the amount of sheets discharged with minor defects during the real-time adjustment to the fixed amount.

Furthermore, as the number of sheets included in the set is smaller, the stopping time is changed to longer time. Thereby, regardless of the number of sheets included in the set, it is possible to suppress the amount of sheets discharged with minor defects during the real-time adjustment to the fixed amount.

Furthermore, as the time required for the post processing by the post processing apparatus is shorter, the stopping time is changed to longer time. Thereby, regardless of the time required for the post processing by the post processing apparatus, it is possible to suppress the amount of sheets discharged with minor defects during the real-time adjustment to the fixed amount.

Furthermore, in the case where the predetermined condition include the plurality of predetermined conditions, the stopping time is changed to the longest stopping time among the stopping times corresponding to the respective predetermined conditions. Thereby, even in the case where the amount of sheets S discharged with defects during the real-time adjustment due to the plurality of predetermined conditions fluctuates, it is possible to suppress the number of sheets with the defects to the fixed amount or less.

Furthermore, in the case where the sheets subjected to image formation include the plurality of sets, correspondingly to the type of the post processing condition, in the interval widening control, whether the interval is widened for each set and whether the interval with the preceding sheet is widened for each predetermined sheet among the sheets included in the set are switched over. Thereby, correspondingly to the type of the post processing condition, the result of the post processing based on the post processing condition after the adjustment can be easily confirmed in synchronization with the timing of the adjustment of the sheet in the post processing of the set.

Furthermore, the type of the post processing condition includes the post processing condition to perform post processing for each set and the post processing condition to perform post processing for each sheet. Thereby, correspondingly to the type of the post processing condition, the result of the post processing based on the post processing condition after the adjustment can be easily confirmed in synchronization with the timing of the adjustment of the sheet in the post processing of the set.

Furthermore, the type of the post processing condition to perform the post processing for each set includes the folding for each set and the stapling for each set. Additionally, the type of the post processing condition to perform the post processing for each sheet includes the aligning for each sheet and the punching for each sheet. Thereby, correspondingly to the type of the post processing condition, the result of the post processing based on the post processing condition after the adjustment can be easily confirmed in synchronization with the timing of the adjustment of the sheet in the post processing of the set.

Furthermore, the interval widening control is changed correspondingly to the first post processing mode or the second post processing mode that are different from each other in the timing of adjustment of sheets in the post processing. In the first post processing mode that adjusts the sheet in the post processing at the timing when the trailing sheet on the most upstream in the conveyance direction among the sheets included in the set, is conveyed to the post processing apparatus, the interval widening control is applied for the trailing sheet. In the second post processing mode that adjusts the sheet in the post processing at the timing when the leading sheet on the most downstream in the conveyance direction among the sheets included in the set, is conveyed to the post processing apparatus, the interval widening control is applied for the leading sheet. Thereby, correspondingly to two modes different from each other in the timing of adjusting sheets in post processing, the result of the post processing based on the post processing condition after the adjustment can be easily confirmed in synchronization with the timing of adjustment of the sheet in the post processing for the set.

The image forming apparatus, image forming system, and non-transitory recording medium storing the computer-readable program for the image forming apparatus according to the present invention are not limited to the above embodiments.

For example, in the above embodiments, the sheet has been described as the example of the recording medium. However, the recording medium is not limited to the sheet, but includes a resin film etc.

Moreover, in the above embodiments, the description is made on the assumption that the interval widening control is to be performed in the case where minor misalignment etc. with a degree not becoming quality defects has occurred on the sheet for which the post processing has been finished. However, even in the case where the degree of misalignment of the sheet having been subjected to the post processing is so high that the sheet becomes waste sheet, the present invention can be applied.

Moreover, a part or all of processing executed by programs in the embodiments may be executed by hardware such as circuits in place of the programs.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus, comprising:

a conveyor that conveys a recording medium on a conveyance passage;

an image former that performs image formation for the recording medium being conveyed;

a receiver that receives an instruction of adjustment start of post processing condition by a post processing apparatus without stopping a print job during continuous output operation that performs image formation continuously for a plurality of recording mediums, performs post processing for the plurality of recording mediums by said post processing apparatus, and outputs the plurality of recording mediums; and a hardware processor that performs interval widening control for the recording medium being conveyed on said conveyance passage so as to convey the recording medium by widening an interval with a preceding recording medium from a time when the instruction of adjustment start of the post processing condition has been received.

2. The image forming apparatus as claimed in claim 1, wherein said receiver receives a setting instruction of an adjustment value of said post processing condition after having received said instruction of adjustment start of said post processing condition, and said hardware processor adjusts said post processing condition of said post processing apparatus based on the received setting instruction of the adjustment value of said post processing condition.

3. The image forming apparatus as claimed in claim 2, wherein after the instruction of adjustment start of said post processing condition has been received, said hardware processor performs said interval widening control by changing a conveyance speed of the recording medium passing through a predetermined position on said conveyance passage from a first conveyance speed to a second conveyance speed slower than said first conveyance speed.

4. The image forming apparatus as claimed in claim 3, wherein said receiver receives a determination instruction for the adjustment value of said post processing condition after having received the setting instruction for the adjustment value of said post processing condition, and said hardware processor changes the conveyance speed of the recording medium passing through said predetermined position from said second conveyance speed to said first conveyance speed after the determination instruction for the adjustment value of said post processing condition has been received.

5. The image forming apparatus as claimed in claim 3, wherein said hardware processor sets said second conveyance speed in accordance with a predetermined condition to said second conveyance speed corresponding to said predetermined condition.

6. The image forming apparatus as claimed in claim 5, wherein said predetermined condition is a condition relating to a length of the recording medium in a conveyance direction, and as a length of the recording medium in the conveyance direction is shorter, said hardware processor sets said second conveyance speed to a slower speed.

7. The image forming apparatus as claimed in claim 5, wherein said predetermined condition is a condition relating to a basis weight of the recording medium, and as the basis weight of the recording medium is smaller, said hardware processor sets said second conveyance speed to a slower speed.

8. The image forming apparatus as claimed in claim 5, wherein said predetermined condition is a condition relating to a number of recording mediums included in a set, and as the number of recording mediums included in the set is smaller, said hardware processor sets said second conveyance speed to a slower speed.

9. The image forming apparatus as claimed in claim 5, wherein said predetermined condition is a condition relating to time required for post processing by said post processing apparatus, and as time required for post processing by said post processing apparatus is shorter, said hardware processor sets said second conveyance speed to a slower speed.

10. The image forming apparatus as claimed in claim 5, wherein in a case where said predetermined condition includes a plurality of predetermined conditions, said hardware processor sets said second conveyance speed to a slowest speed among said second conveyance speeds corresponding to the respective predetermined conditions.

11. The image forming apparatus as claimed in claim 2, wherein after the instruction of adjustment start of said post processing condition has been received, said hardware processor performs said interval widening control by stopping temporarily the recording medium passing through a predetermined position on said conveyance passage at said predetermined position.

12. The image forming apparatus as claimed in claim 11, wherein said predetermined position is a position of a registration roller.

13. The image forming apparatus as claimed in claim 11, wherein said receiver receives a determination instruction for the adjustment value of said post processing condition after having received the setting instruction for the adjustment value of said post processing condition, and after the determination instruction for the adjustment value of said post processing condition has been received, said hardware processor makes the recording medium passing through said predetermined position pass without stopping the recording medium at said predetermined position.

14. The image forming apparatus as claimed in claim 11, wherein after the instruction of adjustment start of said post processing condition has been received, said hardware processor sets a stopping time when stopping the recording medium passing through said predetermined position at said predetermined position, to said stopping time corresponding to a predetermined condition.

15. The image forming apparatus as claimed in claim 5, wherein said predetermined condition is a condition relating to at least one of a length of the recording medium in a conveyance direction, a basis weight of the recording medium, a number of recording mediums included in a set, and time required for post processing by the post processing apparatus.

16. The image forming apparatus as claimed in claim 14, wherein said predetermined condition is a condition relating to a length of the recording medium in a conveyance direction, and as a length of the recording medium in the conveyance direction is shorter, said hardware processor sets said stopping time to longer time.

17. The image forming apparatus as claimed in claim 14, wherein said predetermined condition is a condition relating to a number of recording mediums included in a set, and as the number of recording mediums included in the set is smaller, said hardware processor sets said stopping time to longer time.

18. The image forming apparatus as claimed in claim 14, wherein said predetermined condition is a condition relating to time required for post processing by said post processing apparatus, and as time required for post processing by said post processing apparatus is shorter, said hardware processor sets said stopping time to longer time.

19. The image forming apparatus as claimed in claim 14, wherein in a case where said predetermined condition includes a plurality of predetermined conditions, said hardware processor sets said stopping time to a longest stopping time among said stopping times corresponding to the respective predetermined conditions.

20. The image forming apparatus as claimed in claim 1, wherein in a case where recording mediums having been subjected to image formation include a plurality of sets, correspondingly to a type of said post processing condition, in said interval widening control, with respect to the recording medium being conveyed on said conveyance passage, said hardware processor switches over whether to widen an interval for each set or whether to widen an interval with the preceding sheet for each recording medium included in the set.

21. The image forming apparatus as claimed in claim 20, wherein the type of said post processing condition includes a post processing condition to perform post processing for each set and a post processing condition to perform post processing for each sheet.

22. The image forming apparatus as claimed in claim 21, wherein the type of said post processing condition to perform post processing for each set includes folding for each set and stitching for each set, and the type of said post processing condition to perform post processing for each recording medium includes aligning for each recording medium and punching for each recording medium.

23. The image forming apparatus as claimed in claim 1, wherein in a case where post processing by said post processing apparatus is performed for each set, in a first post processing mode to adjust the recording medium in post processing at a timing when a trailing recording medium on a most upstream in a conveyance direction among recording mediums included in the set is conveyed to said post processing apparatus, said hardware processor performs said interval widening control for said trailing recording medium so as to widen an interval with the preceding recording medium, and in a second post processing mode to adjust the recording medium in post processing at a timing when a leading recording medium on a most downstream in the conveyance direction among recording mediums included in the set is conveyed to said post processing apparatus, said hardware processor performs said interval widening control for said leading recording medium so as to widen an interval with the preceding recording medium.

24. An image forming system, comprising:

a conveyor that conveys a recording medium on a conveyance passage;

an image former that performs image formation for the recording medium being conveyed;

a post processor that performs post processing for the recording medium having been subjected to image formation;

a receiver that receives an instruction of adjustment start of post processing condition by said post processor without stopping a print job during continuous output operation that performs image formation continuously for a plurality of recording mediums, performs post processing for the plurality of recording mediums, and outputs the plurality of recording mediums; and a hardware processor that performs interval widening control for the recording medium being conveyed on said conveyance passage so as to convey the recording medium by widening an interval with a preceding recording medium from a time when the instruction of adjustment start of said post processing condition has been received.

25. A non-transitory recording medium storing a computer-readable program causing an image forming apparatus to perform:

(a) conveying a recording medium on a conveyance passage;

(b) performing image formation for the recording medium being conveyed;

(c) receiving an instruction of adjustment start of post processing condition by an post processing apparatus without stopping a print job during continuous output operation that performs image formation continuously for a plurality of recording mediums, performs post processing by said post processing apparatus, and outputs the plurality of recording mediums; and (d) performing interval widening control for the recording medium being conveyed on said conveyance passage so as to convey the recording medium by widening an interval with a preceding recording medium from a time when the instruction of adjustment start of said post processing condition has been received.

* * * * *